US005108065A

United States Patent [19]

Puerner

[11] Patent Number: 5,108,065

[45] Date of Patent: Apr. 28, 1992

[54] SUSPENSION FRAMEWORK FOR CHAIRS OR FURNITURE USED FOR SLEEPING

[76] Inventor: Siegfried Puerner, Adam Krafft Strasse 6, D-8590 Marktredwitz, Fed. Rep. of Germany

[21] Appl. No.: 383,796

[22] Filed: Jul. 21, 1989

[30] Foreign Application Priority Data

Oct. 21, 1988 [DE] Fed. Rep. of Germany ... 8813236[U]

[51] Int. Cl.[5] ..... A47G 29/00

[52] U.S. Cl. ..... 248/370; 5/127; 248/188.1

[58] Field of Search ..... 248/370, 188.1, 317; 5/127; 297/273, 281, 282

[56] References Cited

U.S. PATENT DOCUMENTS

| | | | |
|---|---|---|---|
| 1,120,931 | 12/1914 | Gosso | 5/127 X |
| 1,319,582 | 10/1919 | Hebert | 297/282 X |
| 1,795,202 | 3/1931 | Dillingham | 297/282 X |
| 1,862,953 | 6/1932 | Couch | 297/282 X |
| 2,567,612 | 9/1951 | McGehee | 248/370 X |
| 2,667,207 | 1/1954 | Magyar | 248/370 X |
| 3,994,468 | 11/1976 | Carter et al. | 248/370 |
| 4,114,209 | 9/1978 | Sandlin | 248/370 X |
| 4,958,391 | 9/1990 | Egeland | 5/127 |

*Primary Examiner*—David L. Talbott
*Attorney, Agent, or Firm*—Gifford, Groh, Sprinkle, Patmore and Anderson

[57] ABSTRACT

A suspension framework for a chair or piece of sleeping furniture, which is able to oscillate, is comprised of a support member 13, 22 which is connected to the sitting or sleeping surface and arranged on both sides thereof, and which is connected with a base support member 1, 26 via rope-type pendulums 5, 6, 11, 24. At least two rope-type pendulums engage the support member on each side thereof. This will enable, in a system having satisfactory stability characteristics, a high degree of sensitivity in response to very minute movements of the human body or under oscillating conditions occurring in the human body that is seemingly at rest.

8 Claims, 1 Drawing Sheet

Fig-1
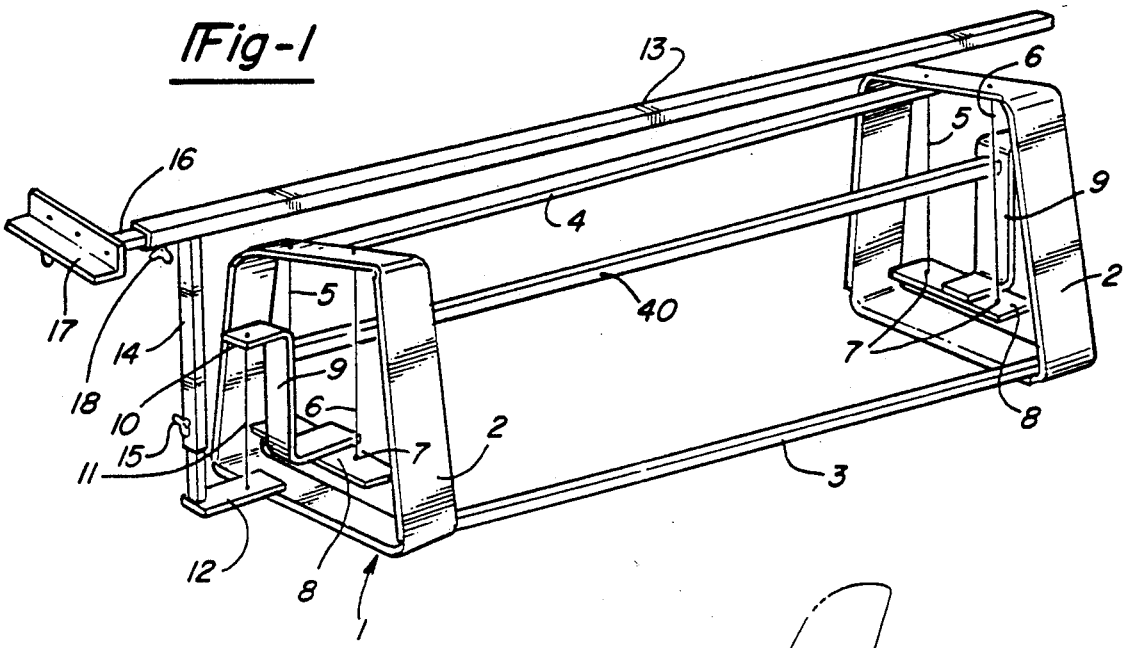
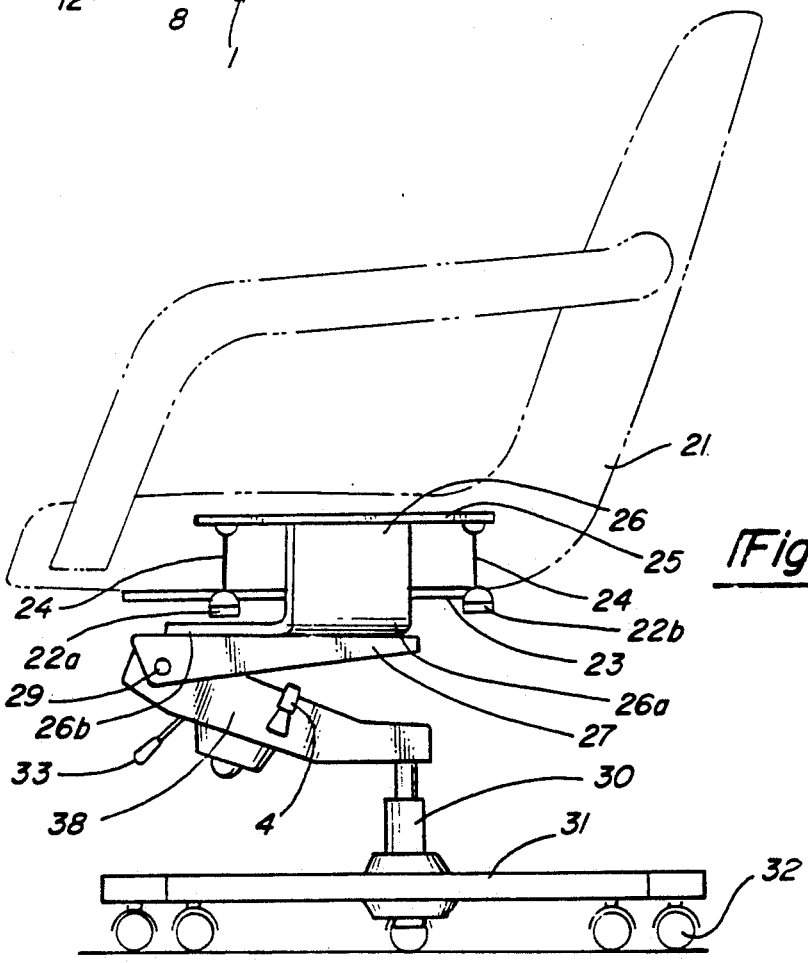
Fig-2

SUSPENSION FRAMEWORK FOR CHAIRS OR FURNITURE USED FOR SLEEPING

The invention relates to a suspension framework for a chair or a piece of furniture used for sleeping. The suspension framework according to the invention is adapted to oscillate and consists of a support member which engages the sitting or sleeping surface which, in turn, is coupled to a base support member by way of a rope-type pendulum.

A suspension frame of this type provides a dynamic chair or piece of sleeping furniture which enables the surface used for sitting or sleeping to oscillate in response to even very minute body movements.

The disadvantage of prior art furniture of this type is that their stability is not very reliable and that their sensitivity in response to very minute body movements leaves much to be desired. Another shortcoming is that a person desiring the above-mentioned features, rather than being able to convert the existing furniture, must purchase a special type of furniture. Therefore, it is the object of this invention to provide a suspension framework of the type described above which, while exhibiting satisfactory static motionless characteristics, is more sensitive in response to human body movements and which enables to the conversion of existing furniture used for sitting or sleeping to the type of furniture described in the foregoing.

The invention is based on the recognition that body movements which are hardly noticeable, or movements which may take place only inside the body while the body itself is seemingly at rest, must be transmitted to the surface used for supporting the body if a biological, health-promoting vibratory system between the body and the seating or sleeping furniture is to be provided.

Therefore, it is the object of this invention to provide a suspension framework of the type described in the foregoing which, while exhibiting satisfactory motionless characteristics, is extremely sensitive in response to body movements which are only of a minor nature and which occur in the human body while it is seemingly at rest.

The principal characteristic of the invention is the fact that at least two rope-type pendulum members are acting upon the support member on each side thereof.

In accordance with one advantageous feature of the invention, the support member which, preferably, is adjustable relative to the sitting or sleeping surface or in height, is suspended, by way of a support member rope-type pendulum on an intermediate support member, and that spaced at a distance therefrom, the intermediate support member is attached to the base support member so as to be suspended therefrom by means of a pair of intermediate support member rope-type pendulums which are also spaced apart at a distance from each other.

In accordance with another feature of the invention, it is proposed that the projections of the support member rope-type pendulum and the intermediate support member rope-type pendulums form a triangle in the plane of the seating or sleeping surface.

To achieve this end it is preferable that the two intermediate support member rope-type pendulums are in alignment relative to each other in the longitudinal direction of the sleeping surface.

In accordance with an advantageous embodiment of the invention, the two rope-type pendulums for the intermediate support member are connected at their lower ends with a connecting plate to which the intermediate support member is attached.

An additional feature resides in an arrangement in which the base support member is comprised of a pair of vertically arranged trapezoidal frames, said frames being interconnected by means of transverse members which extend transversely relative to the seating or sleeping surface, the arrangement being such that the transverse members extend, preferably, into oppositely arranged corner points of the trapezoidal frame.

In accordance with another advantageous feature of the invention, the rope-type pendulum members are in the form of steel cables, and the rope-type pendulum members for the intermediate support members are of a smaller diameter than the rope-type pendulum members for the support member.

According to another further feature of the invention, a base support member, which is preferably connected with a pedestal for a chair, is connected on either side of the chair or sleeping-type furniture with an interconnecting support member, with the rope-type pendulum member or members being articulated to one end of said interconnecting support member, and the other end of the rope-type pendulum member being connected with a support member, which may be in the form of a support frame or may be attached to a rocker, and with the seating or sleeping surface resting upon said support member.

According to a further development of the invention, two or more rope-type pendulum members with intermediate support members are arranged in tandem between the interconnecting support member and the support member.

According to another arrangement, the invention proposes that the interconnecting support member be connected, preferably, at its ends with the upper ends of two rope-type pendulums, and that the base support member be bent upwardly in the area between the rope-type pendulum members towards the interconnecting member and be connected therewith.

The invention will be described in detail by way of exemplary embodiments with reference to the accompanying drawings.

FIG. 1 is a perspective view of a suspension frame in which certain details, which are not necessary for the understanding of the invention, have been omitted.

FIG. 2 is a side view of another embodiment of the suspension frame as it is applied in an upholstered chair.

As is apparent from FIG. 1, the suspension framework according to the invention is comprised of a base 1 which is adapted to rest on the floor. The base includes a pair of trapezoid frames 2. Frames 2 are interconnected by means of transverse members 3 and 4 which are attached thereto at oppositely arranged corner points provided in the trapezoid frames 2.

A pair of rope-type pendulum members 5 and 6 for the intermediate support member are suspended from the top of the trapezoid frame 2 and their lower ends are attached to a connecting plate 8. The connecting plate 8 has attached thereto the intermediate support member 9, and the rope-type pendulum member 11 for the support member 13 is suspended from the top of said intermediate support member 9. The lower end of said pendulum member 11 is attached to the arm 12 of the support member 13. The two intermediate support members 9 associated with the, trapezoid frames 2 are interconnected by a connecting rod 40 so as to form a unit.

Arms 12 are mounted for slidable telescopic adjustment in struts 14 which extend vertically to the floor and thus perpendicular to the support member 13. Arm 12 can be fixed to the strut 14 in the desired position by means of a wing nut 15 which enables the height of the support member 13 to be adjusted.

Support member 13 is provided at its ends with telescopically slideable end pieces 16 which have mounting brackets 17 attached thereto and which can be fixed into any desired position on either side of the support member 13. This arrangement enables the framework to be adapted to the width of the boards provided inside a bed frame (not shown in the drawings). Thus, by placing two frameworks, one in front and one in back, onto the boards provided inside a bed frame one will provide a bed with a dynamically oscillating sleeping surface. Since the projections of the two rope-type pendulums 5, 6 for the intermediate support members 9 and the rope-type pendulum 11 for the support member 13 form a triangle in the plane of the sleeping surface, one will ensure that, especially in cooperation with the trapezoid frame 2, there is provided a stable suspension of the support member 13 and thus the oscillating sleeping surface. The intermediate support member rope-type pendulums 5 and 6 are in the form of steel ropes and their diameter is smaller than the support member rope-type pendulums 11, a feature which increases the oscillating sensitivity of the framework.

FIG. 2 illustrates an office chair in which the upholstered portions 21 (shown in broken lines) are mounted on support members 22*a* and 22*b*. The support members extend from the one side of the chair illustrated in the drawing underneath the seating surface 4 to the opposite side of the chair and are interconnected by a cross member 23, so that the support members 22 and the cross member 23 form a support frame. The support members 22 are connected at their ends laterally of the upholstered member 21 with rope-type pendulums 24 which are fastened at the top to the respective ends of a connecting support member 25.

Alternatively, one may also provide between the connecting support member 25 and the support member 22 a plurality of rope-type pendulums arranged in tandem. This arrangement, which is not illustrated in FIG. 2, would necessitate the provision of intermediate support members. The connecting members 25 are connected on either side with a base member 26. In the area below the support member 23, the base member extends underneath the seating surface and is bent upwardly at 26*a* so as to embrace the seating surface and to extend on either side up to the connecting support member 25. The base member 26 is resting on the upper side of two laterally offset rocking members 27 and is rigidly attached thereto. The connection is reinforced in that the base member 26 is provided with two extensions 26*a* in the area of the rocking members 27. Otherwise, the base support member 26 is in the form of a wide strip, as is apparent from FIG. 2.

Between the two rocking members 27 there is provided a mounting block 28 which has the rockers 27 articulated to its forward end by means of a bolt 29. At its opposite rearward end the mounting block 28 is connected with a telescopic piston arrangement 30 which is mounted on a five-arm foot 31. As is common practice, rollers 32 are provided at the ends of the five arms. A locking lever 33 is provided to adjust the oscillating movements of the rockers 27 relative to the mounting block 28, and an adjusting lever 34 permits the pneumatic piston arrangement 30 to be vented so that the seat can be lowered relative to the foot 31.

The framework according to the invention, in conjunction with the rope-type pendulum 24, provides an extremely sensitive suspension system for the upholstered portions 21 relative to the foot so that very minute pressure displacements in the body that occur even at the time when the body seems to be at rest generate oscillations which are otherwise not perceptible, a solution which is of significant therapeutical value. Another advantage of the suspension according to the invention is that it requires relatively little space, so that the dimensions of a chair that has been retrofitted with the suspension described above do not deviate from regular office chairs. Furthermore, this enables ordinary pedestals equipped with adjustable rocker mechanisms and with telescopical height adjusting means to be equipped with the suspension system according to the invention.

Thus, the suspension system according to the invention enables existing furniture to be converted in a satisfactory manner, so that the sitting or sleeping surface may oscillate dynamically in response to the human body. The responsiveness of the suspension system is very sensitive so that body movements that are hardly perceptible cause the system to oscillate.

I claim:

1. A suspension framework for chairs or sleeping furniture having a surface member adapted to support a person, such that the surface member may freely oscillate, said framework comprising:

a base having a pair of spaced apart end members, each of said pair of end members having a pair of rope-type pendulums suspending an intermediate member, each intermediate member further having a single rope-type pendulum suspending a support member, said single rope-type pendulum and said pair of rope-type pendulums being mounted to permit free movement in a pendulum-like arc whereby said surface member is free to oscillate in response to movements of a person using said surface member chair or furniture, said intermediate members of each of said pair of end members being mounted to a connecting rod extending therebetween to maintain said intermediate members in a parallel spaced apart relationship, said support member being further mounted to said surface member.

2. Suspension framework according to claim 1, characterized in that the support member 13 is suspended on an intermediate support member 9 via an intermediate support member rope-type pendulum 11, and in that at a distance therefrom the intermediate support member 9 is suspended on the base support member 1 via a pair of intermediate support member rope-type pendulums 5, 6, which are also spaced apart at a distance from each other.

3. Suspension framework according to claim 2, characterized in that the projections of the support member rope-type pendulum 11 and the intermediate support member rope-type pendulums 5, 6 form a triangle in the plane of the sitting and sleeping surface.

4. Suspension framework according to claim 2, characterized in that the two intermediate support member rope-type pendulums 5, 6 are in alignment with each other in the longitudinal direction of the sitting or sleeping surface.

5. Suspension framework according to claim 2, characterized in that the two intermediate support member rope-type pendulums 5, 6 are connected at their lower ends with a connecting plate 8 to which is fastened, in turn, the intermediate support member 9.

6. Suspension framework according to claim 2, characterized in that the base support member 1 is comprised of two vertically extending trapezoidal frames 2 which are interconnected by cross members 3, 4, with said cross members extending transversely relative to the sitting or sleeping surface and terminating in two oppositely arranged corner points of the trapezoidal frames.

7. Suspension framework according to claim 2, characterized in that the support member 13 is connected to the intermediate support member rope-type pendulum 11 by a telescopic arm 12, 14.

8. Suspension framework according to claim 1, characterized in that the support member 13 is adapted for height adjustment and for adjustment relative to the sitting or sleeping surface.

* * * * *